US007602303B2

(12) United States Patent
Douglas et al.

(10) Patent No.: US 7,602,303 B2
(45) Date of Patent: Oct. 13, 2009

(54) PERSONAL CRIME PREVENTION BRACELET

(76) Inventors: Randy Douglas, 125 William Powell Ct., Aberdeen, MD (US) 21001; Alicia Douglas, 125 William Powell Ct., Aberdeen, MD (US) 21001

( * ) Notice: Subject to any disclaimer, the term of this patent is extended or adjusted under 35 U.S.C. 154(b) by 226 days.

(21) Appl. No.: 11/541,979

(22) Filed: Oct. 2, 2006

(65) Prior Publication Data

US 2008/0001764 A1 Jan. 3, 2008

Related U.S. Application Data

(60) Provisional application No. 60/817,052, filed on Jun. 28, 2006.

(51) Int. Cl.
*G08B 23/00* (2006.01)
*G08B 1/08* (2006.01)

(52) U.S. Cl. ..... 340/573.4; 340/539.11; 340/539.13

(58) Field of Classification Search ..... 340/573.4
See application file for complete search history.

(56) References Cited

U.S. PATENT DOCUMENTS

| | | | | |
|---|---|---|---|---|
| 5,196,825 | A * | 3/1993 | Young | 340/539.11 |
| 5,712,619 | A | 1/1998 | Simkin | |
| 5,742,233 | A | 4/1998 | Hoffman | |
| 6,072,396 | A * | 6/2000 | Gaukel | 340/573.4 |
| 6,396,403 | B1 * | 5/2002 | Haner | 340/573.4 |
| 6,510,380 | B1 | 1/2003 | Curatolo | |
| 6,606,556 | B2 | 8/2003 | Curatolo | |
| 6,889,135 | B2 | 5/2005 | Curatolo | |
| 7,015,817 | B2 | 3/2006 | Copley | |
| 7,038,589 | B2 | 5/2006 | Schmidt | |
| 7,046,139 | B2 | 5/2006 | Kuhn | |

* cited by examiner

*Primary Examiner*—Donnie L Crosland
(74) *Attorney, Agent, or Firm*—Michael Ries

(57) ABSTRACT

The apparatus is a bracelet that can transmit the location of the wearer to a monitoring station using GPS technology to locate the wearer and cellular communication technology to transmit the information. The apparatus can also record and transmit sound and visual information to the monitoring station and receive sound transmissions from the monitoring station. Another embodiment of the apparatus includes a two unit version were one unit can detect the distance to the other unit. Once that distance exceeds a certain maximum, an alarm will sound from the first unit. An alarm can also be sent to the monitoring station. Other versions of the apparatus can have a lock to prevent removal of the apparatus invention from a wearer. The lock can be a biometric lock, such as one operated by a fingerprint.

16 Claims, 2 Drawing Sheets

PERSONAL CRIME PREVENTION BRACELET

CROSS-REFERENCE TO RELATED APPLICATIONS

This application claims the benefit of Provisional Patent Application Ser. No. 60/817,052, filed Jul. 25, 2006 by the present inventor.

FEDERALLY SPONSORED RESEARCH

None

SEQUENCE LISTING OR PROGRAM

None

FIELD OF INVENTION

This invention relates to personal security. More specifically it relates to personal security using a location technology. Even more specifically it relates to personal security using GPS location technology and cellular phone communication technology.

BACKGROUND OF THE INVENTION

U.S. Pat. No. 5,712,619 by Simkin, filed Apr. 18, 1996, is a personal alarm system that can transmit the location of the person sending the alarm to a monitoring station. The '619 patent is housed in a rectangular box with a plunger to activate the alarm. The '619 patent does not include a camera.

U.S. Pat. No. 5,742,233 by Hoffman, filed Jan. 21, 1997, is a device for tracking an individual that can transmit the location of the individual to a monitoring station. The '233 patent includes a means for two-way voice contact. This means could be created using a cell phone transmitter and receiver. The location of the device is monitored by computer at a monitoring station. The monitoring station can send help to the individual. A possible monitoring station is a dispatch operator. The device can be a bracelet. The '233 patent does not include a camera.

U.S. Pat. No. 6,510,380, filed Mar. 30, 2000, U.S. Pat. No. 6,606,556, filed Oct. 31, 2002, and U.S. Pat. No. 6,889,135, filed Jan. 30, 2003, all by Curatolo, all describe a location device that is two devices that send an alarm when the distance between them exceeds a certain maximum distance. The alarm is sent to a monitoring station that includes information on the location of each device. The means to send the alarm and the location information could be sent by a cell phone communication network. Each device can also transmit both voice and data. The monitoring station could be the police, or could be a home unit. The monitoring station could also send the alarm and location information to a remote receiver. The '135 patent is the only one of the three that includes a video camera element. The '135 patent video camera can transmit and receive video signals. The main difference between the '135 patent and the present invention is that the '135 patent requires a two unit system. This patent clearly does not effect the one unit versions of the present invention. The patent is also unlikely to effect the two unit version of the present invention because the way the two units interact is different in the patent and the present invention. Unlike the present invention, the '135 patent requires that the two units send a signal to a monitoring station. The '135 patent does not have the units send a signal between the two units.

The Curatolo patents all claim a two unit system were the units work together to send a signal when the distance between the two units is too great. The present invention also has this feature. The difference between the present invention and the Curatolo patents is that the Curatolo patents only send a signal to the monitoring station when the distance between the two units exceeds a certain maximum. The present invention has the child's unit send an alarm signal directly to the parent's unit. Then either the child's unit or the parent's unit can send a signal to the monitoring station.

U.S. Pat. No. 7,015,817 by Copley, filed Oct. 15, 2004, is a device for monitoring the location of an individual. The device is claimed as a wearable object. The device transmits the location of the individual using a GPS system and a cell phone network. The monitoring station could be the police. The '817 patent does not include a camera.

U.S. Pat. No. 7,046,139 by Kuhn, filed Apr. 26, 2004, uses a home network to monitor the location and media access of a child. The child is wearing a device that broadcasts the child's location. The '139 patent includes a version with a biometric access device. The '139 patent claims a general method of controlling a child's access to a media device using a biometric. The patent also claim's a specific method of using a biometric means to control a child's access to a media device. The specific means requires either a speech biometric or a speech biometric and a fingerprint biometric.

U.S. Pat. No. 7,038,589 by Schumidt, filed Nov. 3, 2002, is a very specific method of tracking an object using electromagnetic pulses. These electromagnetic pulses can be from a cell phone or a GPS unit. The envisioned use is a means to track a child.

SUMMARY OF INVENTION

The invention is a security bracelet that is worn to protect the wearer from accident and criminal acts. The invention has three preferred applications. The first is as a personal security bracelet for an individual. The second is as a security and tracking bracelet for a child so that a parent can monitor the location of the child and security officers can locate the child. The third is as a communication and evidence gathering device for security officers and police officers.

The bracelet is designed to both allow the tracking of the wearer and allow the wearer to communicate with another party to gain assistance. The bracelet allows the wearer to be tracked by broadcasting the wearer global position on a global positioning system, and through cameras and microphones broadcast information about the wearer's location. The wearer can also use the microphone and speaker to communicate with other party for assistance.

The bracelet is meant to be lightweight and can be camouflaged as jewelry. This allows the bracelet to be comfortable to wear. This also allows the bracelet to be concealed so that it is not noticeable. In the case of the police application of the bracelet, the bracelet would allow officers to have a full range of communication equipment with them while in "plainclothes" or "undercover" assignments. The bracelet could be camouflaged to be any piece of clothing or jewelry that would be appropriate to the assignment. Furthermore, the lightweight nature of the invention would allow the officers to not be encumbered by the weight of existing communication equipment.

The bracelet has a power source, such as a battery, an electronic memory, such as flash memory, and a computer processor to manage inputs and outputs to and from the bracelet.

In the preferred embodiment, the bracelet is waterproof and fire resistant. In the preferred embodiment, the bracelet will be durable enough to resist being cut or sawed. A preferred embodiment envisions the bracelet made of titanium.

The bracelet contains a satellite navigation system receiver and a wireless data and voice transmitter. The bracelet can transmit the position of the wearer to another wireless device. The bracelet also has cameras that can also transmit data to another wireless device. The bracelet also has a speaker and microphone, allowing wireless communication with another wireless device.

The preferred embodiment envisions the use of the global positioning system (GPS), but any satellite navigation system could be used.

The other wireless device can be any wireless device. In the preferred embodiment, the wireless device is connected to a computer at a security office.

Alternatively, the security office could be a police station. The wireless device transmits location data and images and sound to the computer at the security office so that the personal at the security office can respond and assist the wearer of the bracelet. The security office could respond by going to the location of the wearer himself or herself, contacting the police directly or contacting a 911 service. The security office could communicate with the wearer of the bracelet by the speakers and microphone. The computer could also record all information transmitted from and to the bracelet for use in future searches and investigations.

The security office could have a software program for a computer that would organize the information from one or more bracelets. This program could display location, video images and status.

Two or more bracelets could be linked so that they will detect the relative distance between the one bracelet and the other bracelets. The means of linking the two bracelets is some form of direct signaling between the two bracelets. The wearer of one bracelet could set an alarm that will sound when the distance between bracelets exceeds a certain number. A single bracelet could detect the distance to multiple other bracelets. In the preferred embodiment, one bracelet will be on a parent and it will be linked to a bracelet on a child. When the child is farther away than the predetermined distance from the parent's bracelet, the parent's bracelet sounds an alarm. At the same time, the child's bracelet is activated and uses a wireless communication function to broadcast the location of the child, images of the child's location, and sound's of the child's location.

The bracelet can also be locked so that it cannot be removed. The in the case of bracelets for children, the key can be held by the parent to prevent the bracelet from being removed or lost. In a preferred embodiment, the lock is a biometric lock. The preferred embodiment of the lock is a biometric lock that uses fingerprint information to operate the lock. The biometric lock is programmed to record a certain fingerprint and open only when that fingerprint is pressed against the sensor for the biometric lock. Some versions of the invention have biometric locks that can record and respond to more than one fingerprint. In other versions of the invention, the biometric lock will record that is incorrect and transmit that fingerprint to the monitoring station. Alternatively, the invention could record an image of the incorrect fingerprint and store that image in memory.

The bracelet is controlled by a plurality of buttons. The bracelet also has a display. The buttons could control functions such as power, transmitting an alert signal, switching on the microphone and setting the distance for an alarm. The display could show the distance between one bracelet and another, as well as other functions.

A preferred function of one button would be an alarm function that would allow the user to call for help at the push of a button. The alarm button would send an alert message to a security office, to a police station or to emergency services, such as "911". The alert would include the location of the individual, as well as images and sounds from that location.

An alternative embodiment could be used by the police. In the police embodiment, the bracelet can be used for communicating between officers and between an officer and the station. The bracelet can also be used to collect evidence. Images recorded by the camera and sounds recorded by the microphone can be stored in the bracelet or transmitted to the station. In addition, the location of each officer can be detected by the station. The bracelet could also have the alarm feature that would allow the officer to call for help with the push of a button. In some embodiments, each bracelet is biometrically fitted for use only by a particular officer.

The purpose of the police embodiment of the invention is to allow the police to carry communication equipment without the weight of the existing equipment. The invention would also allow police to carry this equipment with them even when they are in plain clothes or undercover. Furthermore, the police could call for assistance without alerting those around them that they are doing so or revealing their location. Thus the alarm button sends the location of the officer to a dispatcher who can send assistance without the officer needing to speak. Furthermore, the invention can be concealed in jewelry or clothing, thus hiding the presence of the invention and allowing police to always have a full array for equipment with them.

Other embodiments could have a design or decoration integrated into the bracelet. Possible designs could be a metal or metallic covering. Alternative designs could be camouflage or a costume jewelry design. The invention could also be arranged as another type of piece of jewelry or as a piece of clothing. Some embodiments could have removable coverings or faceplates that would allow the user to change the appearance of the bracelet without changing the bracelet.

BRIEF DESCRIPTION OF THE DRAWINGS

The accompanying drawings, which are incorporated in and form part of the specification, illustrate the embodiments of the present invention and, together with the description, serve to explain the principles of the invention.

DETAILED DESCRIPTION OF THE DRAWINGS

Figure 1:
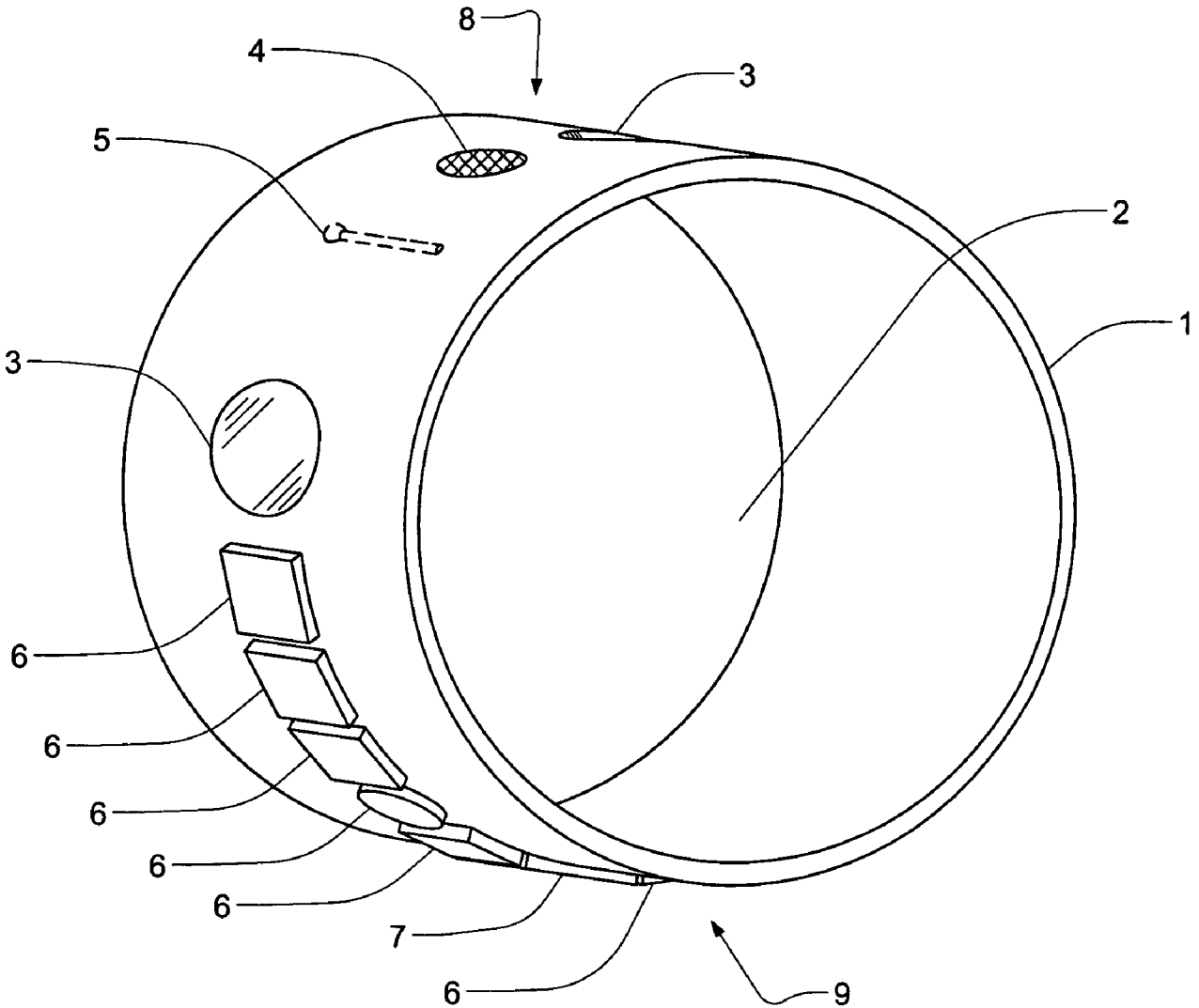
FIG. 1 is a picture of the invention.

FIG. 1 illustrates the invention. The invention is a bracelet 1 with a top 8 and a bottom 9. On the top 8 of the bracelet 1 are three cameras 3 and two speakers 4. Integrated into the bracelet 1 also are two antennas 5. The bottom of the bracelet 1 contains a plurality of buttons 6 and a display 7. FIG. 1 shows the bracelet 1 with ten buttons 6. The bracelet 1 also has a hole 2.

Figure 2:
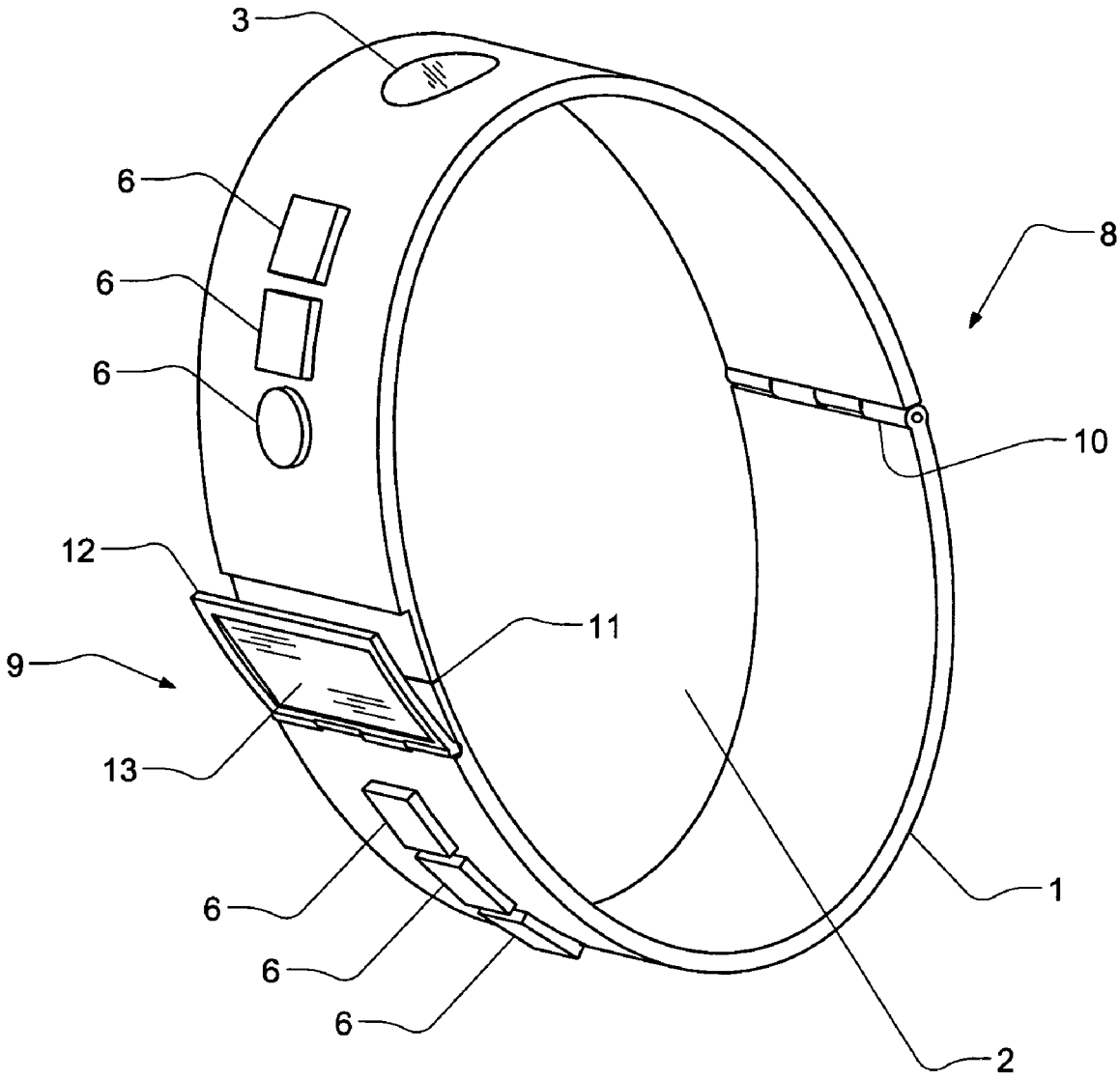
FIG. 2 illustrates a version of the invention with a biometric lock.

FIG. 2 illustrates a version of the invention with a biometric lock. The invention is a bracelet 1 with a top 8 and a bottom 9. On the top 8 of the bracelet 1 are three cameras 3 and two speakers 4. Integrated into the bracelet 1 also are two antennas 5. The bottom of the bracelet 1 contains a plurality of buttons 6 and a display 7. FIG. 1 shows the bracelet 1 with ten buttons 6. The bracelet 1 also has a hole 2. The bracelet 1 opens at opening 11 by moving hinge 10. The opening 11 is locked by lock 12. The lock 12 is controlled by sensor 13.

The bracelet 1 may less than three or more than three cameras 3. The bracelet 1 may have one speaker 4 or more than two speakers 4. The bracelet 1 may have more than ten or less than ten buttons 6. The cameras 3, speakers 4 or antennas 5 may be on the bottom 9. The buttons 6 or display 7 may be on top 8.

The bracelet 1 can have lights associated with the cameras 3. In the preferred embodiment, each camera 3 will have a light to make it easier for the camera to capture images at night or in low light situations. In alternative embodiments, one or more of the cameras 3 can be replaced by a light source.

The speakers 4 can be used for making sound. Alternatively, a microphone can replace one or more of the speakers 4. Alternatively, each speaker 4 can operate as both a speaker and a microphone. When speaker 4 is used in conjunction with the antennas 5, the bracelet 1 can broadcast and receive audio information. The bracelet 1 can thus function as a cell phone. Alternatively, the bracelet 1 can function as a walkie-talkie. The bracelet 1 can also broadcast location information through the antennas 5 and the cameras 3 can broadcast images through the bracelet 1.

The bracelet 1 is controlled by buttons 6. The buttons 6 can be programmed to perform many functions. The buttons 6 can also have the names of these functions printed on or molded into the buttons 6. In the preferred embodiment, some of the buttons 6 functions would be "power", "alarm", "talk" and setting for the range detector for other bracelets. The display 7 can display information such as distance to other bracelets, the settings of this bracelet or the function that has been activated. Any type of button 6 can be used. The buttons 6 can be pop-up buttons. The buttons 6 can also be part of a touch screen.

The buttons 6 can, in some cases, be replaced by receptacles for various input and output devices and cables. One or more of the buttons 6 can be replaced by an input receptacle. These receptacles could input power or data or output data. The data inputs could allow the output of data as well. The buttons 6 can also have lights or Leeds in some of the button 6. These lights or LEDs would allow the button 6 to be lit for easier viewing. These lights or LEDs could also indicate that the function of that button 6 has been activated. In some versions of the invention, some of the buttons 6 are replaced by a light or LED that indicate that a certain function is active. In the preferred embodiment, at least one button 6 will be replaced by a light or LED that indicates that the wireless function is active.

The bracelet 1 can be opened so that the bracelet can be put on and removed more easily. The bracelet 1 opens at opening 11 by turning hinge 10. The hinge 10 can be any kind of hinge. A preferred embodiment of hinge 10 is a pin and knuckle hinge.

The opening 11 is locked by lock 12. In a preferred embodiment, the lock 12 is controlled by a biometric lock. The biometric lock 12 is controlled by a sensor 13. In the preferred embodiment, the sensor 13 detects fingerprints. Once the sensor 13 has been programmed to detect a certain fingerprint, the sensor 13 will only open the lock 12 when the correct fingerprint touches the sensor 13. The sensor 13 can also record any fingerprint that attempts to open the lock 12.

Although this invention has been illustrated by reference to specific embodiments, it will be apparent to those skilled in the art that various changes and modification may be made which clearly fall within the scope of the invention. The invention is intended to be protected broadly within the spirit and scope of the appended claims.

What is claimed is:

1. A personal security bracelet that is lightweight and camouflaged as jewelry comprising:

a global positioning system receiver;

a means to detect and project sound data;

a means to detect visual data;

a means to transmit and receive sound data, visual data and location data;

a means to activate transmission of sound data, visual data and location data;

a means to monitor the sound data, visual data or location data transmitted from the personal security bracelet;

so that a person can activate the personal security bracelet and transmit sound data detected by the personal security bracelet, and transmit visual data detected by the personal security bracelet, and transmit location data determined by the global positioning system receiver so that a person operating the monitoring means can respond the security needs of the person who activated the personal security bracelet, the personal security bracelet locks so that it cannot be removed from the person without opening the lock, the lock is a biometric lock that uses fingerprint information from a sensor, the sensor records any fingerprint that attempts to open the lock, the camouflaged as jewelry bracelet is costume jewelry with removable coverings that allow a user to change the appearance of the bracelet without changing the bracelet, at least one receptacle for a selected one or any combination of input device, output devices, cables, input power, input data and output data.

2. The personal security bracelet of claim 1 where the means of transmitting sound data is a cellular telephone system.

3. The personal security bracelet of claim 1 where the means of transmitting visual data is a cellular telephone system.

4. The personal security bracelet of claim 1 where the means of transmitting location data from the global positioning system receiver is a cellular telephone system.

5. The personal security bracelet of claim 1 where the means of detecting sound data is a microphone.

6. The personal security bracelet of claim 1 where the means of projecting sound data is a speaker.

7. The personal security bracelet of claim 1 where the means of detecting visual data is a camera.

8. The personal security bracelet of claim 1 where the means of monitoring transmission from the personal security bracelet is a computer connected to a cellular telephone system that can receive sound data, visual data and location data from the personal security bracelet through the cellular telephone network.

9. The personal security bracelet of claim 1 where a second personal security bracelet can monitor the distance between a first personal security bracelet and the second personal security bracelet through direct signaling between the two personal security bracelets.

10. The personal security bracelet of claim 9 where the second personal security bracelet that is monitoring the first personal security bracelet is monitoring the first personal security bracelet for the distance between the location of the first personal security bracelet and the second personal security bracelet and will alert the operator of the second personal security bracelet when the distance between the first personal security bracelet and the second personal security bracelet exceeds a certain distance.

11. The personal security bracelet of claim 9 where the second personal security bracelet that is monitoring the first personal security bracelet is monitoring the first personal security bracelet for the distance between the location of the first personal security bracelet and the second personal security bracelet and will alert the operator of the second personal security bracelet when the distance between the first personal security bracelet and the second personal security bracelet exceeds a certain distance, as determined by the global positioning system receivers.

12. The personal security bracelet of claim 8 where the computer monitoring the personal security bracelet is part of a security service that will respond to any alarm from the wearer of the personal security bracelet.

13. The personal security bracelet of claim 8 where the computer monitoring the personal security bracelet is located in a police station and is monitored by the police.

14. The personal security bracelet of claim 1 where the personal security bracelet has an integrated light source so that the user can illuminate an area and improve the means of detecting visual data.

15. The personal security bracelet of claim 1 where the personal security bracelet is worn by a police officer as a communication and evidence recording device.

16. The personal security bracelet of claim 1 where the personal security bracelet has a means of recording data.

* * * * *